US007581686B2

(12) United States Patent
Holzgrefe et al.

(10) Patent No.: US 7,581,686 B2
(45) Date of Patent: Sep. 1, 2009

(54) FUEL INJECTION VALVE

(75) Inventors: Volker Holzgrefe, Ditzingen (DE); Günther Hohl, Stuttgart (DE); Michael Hübel, Gerlingen (DE); Jürgen Stein, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/450,963

(22) PCT Filed: Aug. 22, 2002

(86) PCT No.: PCT/DE02/03073

§ 371 (c)(1),
(2), (4) Date: Nov. 13, 2003

(87) PCT Pub. No.: WO03/038272

PCT Pub. Date: May 8, 2003

(65) Prior Publication Data

US 2004/0075001 A1 Apr. 22, 2004

(30) Foreign Application Priority Data

Oct. 24, 2001 (DE) ..... 101 52 415

(51) Int. Cl.
*B05B 1/32* (2006.01)

(52) U.S. Cl. ..... 239/456; 239/102.2; 239/499; 239/518; 239/533.7; 239/533.12

(58) Field of Classification Search ..... 239/533.12, 239/585.1–585.5, 456–460, 499, 504, 506, 239/518, 521–524, 533.7, 601, 102.2
See application file for complete search history.

(56) References Cited

U.S. PATENT DOCUMENTS

| | | | | | |
|---|---|---|---|---|---|
| 1,310,970 | A | * | 7/1919 | Stroud | 313/120 |
| 2,860,780 | A | * | 11/1958 | Ziesche et al. | 239/533.7 |
| 4,069,978 | A | * | 1/1978 | El Moussa | 239/533.2 |
| 4,421,280 | A | | 12/1983 | Lewis et al. | |
| 4,691,864 | A | * | 9/1987 | Greeves | 239/453 |
| 4,759,335 | A | | 7/1988 | Ragg et al. | |
| 4,825,828 | A | | 5/1989 | Ragg et al. | |
| 4,979,479 | A | * | 12/1990 | Furukawa | 123/472 |
| 5,577,473 | A | | 11/1996 | Linder | |

FOREIGN PATENT DOCUMENTS

| | | |
|---|---|---|
| DE | 1 176 926 | 8/1964 |
| DE | 3 300 670 | 8/1983 |
| DE | 3 734 737 | 4/1988 |
| DE | 44 05 921 | 8/1995 |
| DE | 44 21 280 | 10/1995 |

(Continued)

*Primary Examiner*—Christopher S Kim
(74) *Attorney, Agent, or Firm*—Kenyon & Kenyon LLP

(57) ABSTRACT

A fuel injector for the injection of fuel into the combustion chamber of an internal combustion engine includes a valve needle guided in a nozzle body, the valve needle being actuable by an actuator and acted upon by a restoring spring in such a manner that a valve-closure member which is in operative connection to the valve needle is retained in sealing contact against a valve-seat surface. Formed at a downstream-side end of the fuel injector is a projection which projects beyond the valve-closure member of the fuel injector.

1 Claim, 2 Drawing Sheets

FOREIGN PATENT DOCUMENTS

| | | |
|---|---|---|
| DE | 44 08 553 | 1/1996 |
| DE | 195 34 445 | 3/1997 |
| DE | 198 43 570 | 3/2000 |
| DE | 199 46 693 | 3/2000 |
| EP | 1 036 933 | 9/2000 |
| JP | 4179855 | 6/1992 |
| JP | 04 179855 | 10/1992 |

* cited by examiner

FUEL INJECTION VALVE

BACKGROUND INFORMATION

For instance, from German Patent Application No. 195 34 445, an outwardly opening fuel injector is known which has a conical sealing seat. The valve needle has a central bore which leads into a pressure chamber located upstream from the sealing seat. An actuator, which is embodied as a piezoelectric actuator, on one side is braced against a nozzle body and on the other side against a pressure shoulder which is connected to the valve needle by force-locking. A restoring spring keeps the valve needle in a closing position. In response to the actuator being energized, the valve needle, due to the actuator's longitudinal expansion, is opened against the closing force of the restoring spring and fuel is spray-discharged.

Disadvantageous in the fuel injector known from German Patent No. 195 34 445 is, in particular, that the fuel jet injected into the combustion chamber of the internal combustion engine has a conical shape and is symmetrical to a longitudinal axis of the fuel injector. A slanted injection and an asymmetrical deformation of the conical jet, to compensate for a tight fitting position of the fuel injector, for instance, is not possible here.

SUMMARY OF THE INVENTION

The fuel injector according to the present invention has the advantage over the related art that a slanted injection at any desired angle γ and a selected deformation of the injected mixture cloud are possible by simple measures with regard to the contour of the nozzle body.

This is realized by a projection which surrounds the sealing seat, in part or completely, and which may be adapted according to the demands on form and direction of the fuel jet.

The projection advantageously has an annular design and includes a recess whose longitudinal axis is tilted with respect to a longitudinal axis of the fuel injector. Any desired injection angle may be realized by a more or less pronounced tilting of the axes with respect to each another.

Furthermore, it is advantageous that the projection may also be embodied in the form of one or a plurality of nipples which deform the mixture cloud in a desired manner.

The projection or the nipples are formed in a simple manner either integrally with the nozzle body or are affixed thereto using suitable technology, such as welding or soldering.

DETAILED DESCRIPTION

Figure 1:
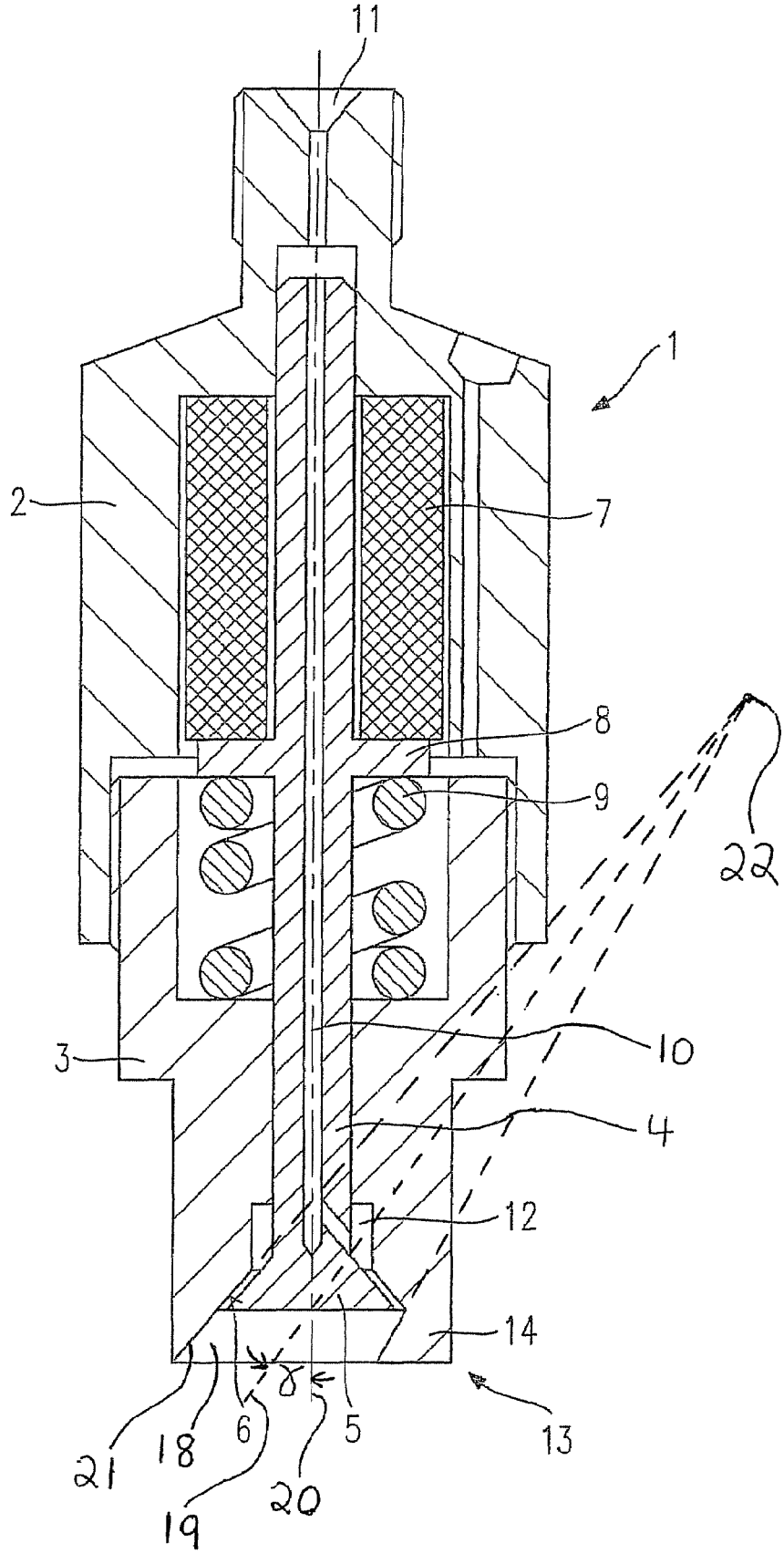
FIG. 1 shows a schematic section through a first exemplary embodiment of a fuel injector configured according to the present invention.

A first exemplary embodiment of a fuel injector 1 according to the present invention, shown in FIG. 1, is designed in the form of a fuel injector 1 for fuel-injection systems of mixture-compressing internal combustion engines having externally supplied ignition. Fuel injector 1 is particularly suited for the direct injection of fuel into a combustion chamber (not shown) of an internal combustion engine.

Fuel injector 1 includes a housing body 2 and a nozzle body 3, in which a valve needle 4 is positioned. Valve needle 4 is in operative connection to a valve-closure member 5 which cooperates with a valve-seat surface 6 to form a sealing seat. The fuel injector in the exemplary embodiment is an outwardly opening fuel injector 1. It includes an actuator 7 which is embodied as a piezoelectric actuator 7 in the exemplary embodiment. On one side, the actuator is braced on housing body 2, and on the other side on a shoulder 8 which is in operative connection to valve needle 4. Downstream from shoulder 8 is a restoring spring 9 which in turn is braced on nozzle body 3.

Valve needle 4 has a fuel channel 10 through which the fuel, conveyed through an inflow-side central fuel feed 11, is guided to the sealing seat. On the inflow side of the sealing seat, a swirl chamber 12 is formed into which fuel channel 10 opens.

In the rest state of fuel injector 1, the force of restoring spring 9 acts upon shoulder 8 counter to the lift direction, in such a way that valve-closure member 5 is retained in sealing contact against valve-seat surface 6. In response to piezoelectric actuator 7 being energized, it expands in the axial direction, counter to the spring force of restoring spring 9, so that shoulder 8 with valve needle 4, which is joined to shoulder 8 by force-locking, is moved in the lift direction. Valve-closure member 5 lifts off from valve-seat surface 6, and the fuel conveyed via fuel channel 10 is spray-discharged.

When the energizing current is switched off, the axial expansion of piezoelectric actuator 7 is reduced, so that the pressure of restoring spring 9 moves valve needle 4 counter to the lift direction. Valve closure member 5 sets down on valve-seat surface 6, and fuel injector 1 is closed.

According to the present invention, fuel injector 1, at a discharge-side end 13, has a projection 14 which encloses valve-closure member 5 at least partially. In the present first exemplary embodiment, projection 14 is designed such that it encloses valve-closure member 5 in its entirety and, in doing so, forms an annular structure. Projection 14 has a recess 18 whose longitudinal axis 19 is tilted relative to a longitudinal axis 20 of fuel injector 1. By such a design of projection 14, an angle γ defining the spray-discharge direction of fuel injector 1 may be adjusted as desired. Fuel injectors 1 having slanted injection are important especially in those instances where the installation space is limited or when a spark plug, which must not be exposed to direct injection, is located in the immediate vicinity of fuel injector 1.

Recess 18 has a slanted conical shape in the exemplary embodiment and widens toward the combustion chamber. If a wall 21 of recess 18 and the longitudinal axis of recess 18 are extended upwardly, it becomes apparent that the extended wall 21 forms an oblique circular cone having a vertex 22, and that the recess 18 is a frustum of this oblique circular cone.

Projection 14 may be integrally formed with the discharge-side end 13 or with nozzle body 3 of fuel injector 1, as shown in the first exemplary embodiment, or it may be affixed retroactively using a suitable technology such as soldering or welding.

Figure 2:
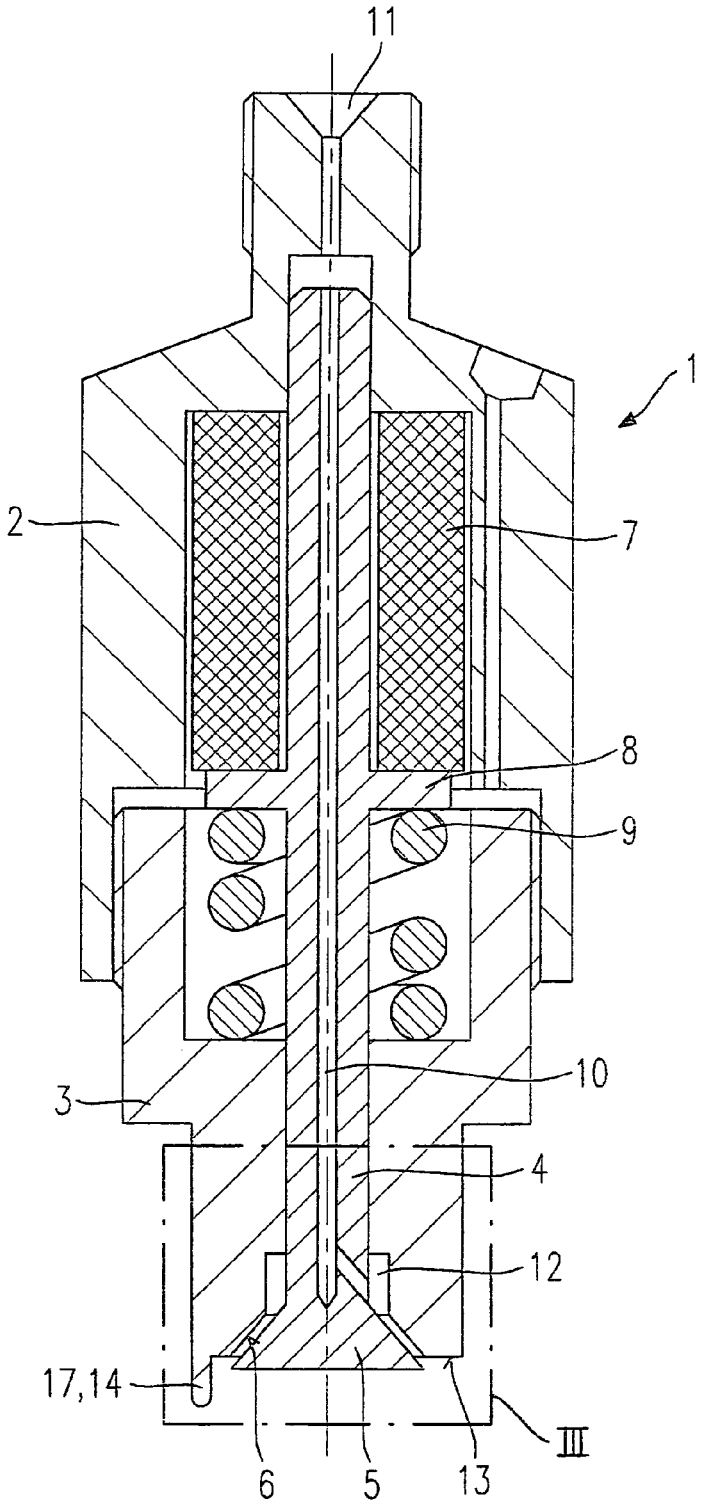
FIG. 2 shows a schematic section through a second exemplary embodiment of a fuel injector configured according to the present invention.

In a sectional view, FIG. 2 shows a second exemplary embodiment of a fuel injector 1 configured according to the present invention. Identical components bear the same reference numerals. With the exception of the measures of the present invention, fuel injector 1 in the second exemplary embodiment may have a design that is identical to that in the first exemplary embodiment, so that a repetitious description of already discussed components may be dispensed with.

In the present second exemplary embodiment, projection 14, which forms an annular structure in the first exemplary embodiment, is now embodied in the form of a nipple 17 in only one spot on the downstream-side end 13 of fuel injector 1. By a suitable selection of the axial length and the angular range covered by nipple 17, it is possible to deform the mixture cloud injected into the combustion chamber of the internal combustion engine.

Figure 3:
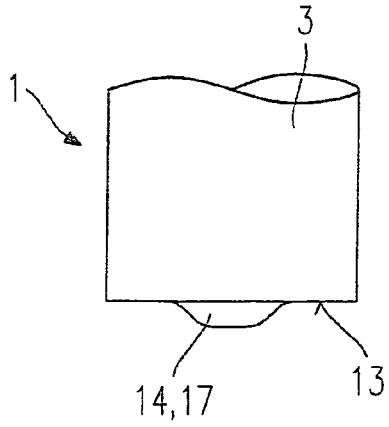
FIG. 3 shows a schematic cut-away portion of the exemplary embodiment of a fuel injector configured according to the present invention shown in FIG. 2, in region III in FIG. 2, in a rotated view.

In FIG. 3, the downstream-side end 13 of fuel injector 1 according to the cut-away portion designated III in FIG. 2, is represented in a view rotated by 90°, thereby showing the extension of nipple 17 more clearly. Nipple 17 may either be integrally formed with nozzle body 3 or retroactively affixed thereto by means of welding or soldering.

Figure 4:
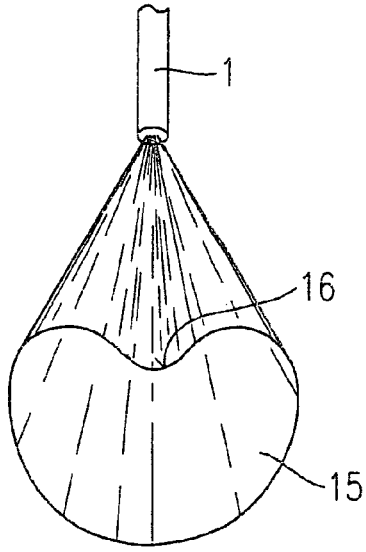
FIG. 4 shows a schematic representation of a mixture cloud injected into the combustion chamber using the fuel injector configured according to the present invention, as represented in FIGS. 2 and 3.

FIG. 4 shows a mixture cloud 15 which is injected into the combustion chamber of the internal combustion engine using fuel injector 1 shown in the exemplary embodiment in FIG. 2. Due to the shielding effect of nipple 17, mixture cloud 15 has a dent 16 in this region, which may, for instance, be arranged in such a way that a spark plug adjacent to fuel injector 1 is not directly exposed to injected fuel, thereby reducing the coking of the spark plug.

Mixture cloud 15 may also be deformed further by positioning a plurality of nipples 17 at arbitrary points on the spray-discharge side end 13 of fuel injector 1, for instance when a plurality of spark plugs is present or the position of the intake and discharge valve seems to require this.

The present invention is not limited to the exemplary embodiments shown, but applicable to electromagnetically actuable fuel injectors 1 as well.

What is claimed is:

1. A fuel injector for a direct injection of fuel into a combustion chamber of an internal combustion engine comprising:

a nozzle body;

a valve needle situated in the nozzle body, the valve needle having a fuel channel, through which fuel conveyed through an inflow-side central fuel feed is guided to a sealing seat;

an actuator for actuating the valve needle;

a valve-closure member, which cooperates with a valve seat surface to form the sealing seat and is in operative connection to the valve needle;

a restoring spring acting upon the valve needle such that the valve-closure member is retained in sealing contact against the valve-seat surface in a non-actuated state of the actuator;

a swirl chamber formed on the inflow side of the sealing seat into which the fuel channel opens;

wherein the fuel injector at a discharge-side end of the nozzle body has a projection into which the valve-closure member is recessed in its entirety to form an annular structure projecting from the downstream side end of the fuel injector in a direction parallel to the longitudinal axis of the fuel injector, the projection having a recess, whose longitudinal axis is tilted relative to a longitudinal axis of the fuel injector, and which provides a slanted injection at an angle $\gamma$ and has a slanted conical shape widening towards a discharge-side end of the fuel injector, resulting in an asymmetric shape of the nozzle body with respect to the longitudinal axis of the fuel injector in the region of the discharge side end; and wherein the projection is integrally formed with the nozzle body of the fuel injector.

* * * * *